US009780458B2

(12) United States Patent
Viscarra et al.

(10) Patent No.: US 9,780,458 B2
(45) Date of Patent: Oct. 3, 2017

(54) METHODS AND APPARATUS FOR ANTENNA HAVING DUAL POLARIZED RADIATING ELEMENTS WITH ENHANCED HEAT DISSIPATION

(71) Applicant: Raytheon Company, Waltham, MA (US)

(72) Inventors: Alberto F. Viscarra, Torrance, CA (US); Jayna J. Shah, Plano, TX (US); Robert S. Isom, Allen, TX (US); Christopher R. Koontz, Manhattan Beach, CA (US)

(73) Assignee: Raytheon Company, Waltham, MA (US)

( * ) Notice: Subject to any disclaimer, the term of this patent is extended or adjusted under 35 U.S.C. 154(b) by 156 days.

(21) Appl. No.: 14/881,582

(22) Filed: Oct. 13, 2015

(65) Prior Publication Data

US 2017/0104277 A1 Apr. 13, 2017

(51) Int. Cl.

| | |
|---|---|
| ***H01Q 21/00*** | (2006.01) |
| ***H01Q 1/52*** | (2006.01) |
| ***H01Q 21/24*** | (2006.01) |
| ***H01Q 1/48*** | (2006.01) |
| ***H01Q 21/06*** | (2006.01) |

(52) U.S. Cl.

CPC ..... *H01Q 21/24* (2013.01); *H01Q 1/48* (2013.01); *H01Q 1/526* (2013.01); *H01Q 21/0006* (2013.01); *H01Q 21/0025* (2013.01); *H01Q 21/0087* (2013.01); *H01Q 21/061* (2013.01)

(58) Field of Classification Search

CPC ..... H01Q 1/002; H01Q 1/02; H01Q 21/0006; H01Q 21/0025; H01Q 21/06; H01Q 21/061; H01Q 21/062; H01Q 21/24; H01Q 21/26; H01Q 1/48; H01Q 1/526

See application file for complete search history.

(56) References Cited

U.S. PATENT DOCUMENTS 3,414,892 A 12/1968 McCormack et al.
3,528,050 A 9/1970 Hindenburg
(Continued)

FOREIGN PATENT DOCUMENTS

EP 2154747 A1 2/2010
EP 2704259 A2 3/2014
(Continued)

OTHER PUBLICATIONS

Notification of Transmittal of the International Search Report and the Written Opinion of the International Searching Authority, or the Declaration; PCT/US2016/034045; date of mailing Aug. 30, 2016, 11 pages.

(Continued)

*Primary Examiner* — Tho G Phan
*Assistant Examiner* — Patrick Holecek
(74) *Attorney, Agent, or Firm* — Daly, Crowley, Mofford & Durkee, LLP

(57) ABSTRACT

Methods and apparatus for a dual polarized thumbtack radiator having enhanced dissipation. In embodiments, a power divider resistor for a balun is coupled directly to ground plane blocks that provide a RF shield. An attachment mechanism, such as a screw secures the thumbtack assembly to an aperture plate and provides thermal and electrical connection.

16 Claims, 14 Drawing Sheets

(56) References Cited

U.S. PATENT DOCUMENTS 3,624,587 A 11/1971 Conrad
3,960,424 A 6/1976 Weisenburger
4,479,686 A 10/1984 Hoshino et al.
4,686,536 A 8/1987 Allcock
4,690,471 A 9/1987 Marabotto et al.
5,060,369 A 10/1991 Date
5,146,308 A 9/1992 Chance et al.
5,172,082 A 12/1992 Livingston et al.
5,244,395 A 9/1993 DeSantis et al.
5,338,207 A 8/1994 Lineberry et al.
5,355,283 A 10/1994 Marrs et al.
5,410,281 A 4/1995 Blum
5,453,751 A 9/1995 Tsukamoto et al.
5,455,546 A 10/1995 Frederick et al.
5,603,620 A * 2/1997 Hinze ..... H01R 13/65802 361/816
5,644,277 A 7/1997 Gulick et al.
5,661,901 A 9/1997 King
5,880,694 A 3/1999 Wang et al.
5,886,590 A 3/1999 Quan et al.
5,938,455 A 8/1999 Glovatsky et al.
6,100,775 A 8/2000 Wen
6,114,221 A 9/2000 Tonti et al.
6,147,648 A 11/2000 Granholm et al.
6,166,701 A 12/2000 Park et al.
6,307,160 B1 10/2001 Mei et al.
6,424,298 B1 7/2002 Nishikawa et al.
6,459,415 B1 10/2002 Pachal et al.
6,512,487 B1 1/2003 Taylor et al.
6,664,867 B1 12/2003 Chen
6,822,617 B1 11/2004 Mather et al.
6,830,460 B1 12/2004 Rathburn
6,856,297 B1 2/2005 Durham et al.
6,867,742 B1 3/2005 Irion, II et al.
6,876,336 B2 4/2005 Croswell et al.
6,882,247 B2 4/2005 Allison et al.
6,891,511 B1 5/2005 Angelucci
6,935,866 B2 8/2005 Kerekes et al.
6,950,062 B1 9/2005 Mather et al.
6,977,623 B2 12/2005 Durham et al.
7,012,572 B1 3/2006 Schaffner et al.
7,084,827 B1 8/2006 Strange et al.
7,113,142 B2 9/2006 McCarville et al.
7,132,990 B2 11/2006 Stenger et al.
7,138,952 B2 11/2006 Mcgrath et al.
7,193,490 B2 3/2007 Shimoda
7,221,322 B1 5/2007 Durham et al.
7,272,880 B1 9/2007 Pluymers et al.
7,315,288 B2 1/2008 Livingston et al.
7,358,921 B2 4/2008 Snyder et al.
7,414,590 B2 8/2008 Bij De Vaate et al.
7,444,736 B1 11/2008 Warning
7,675,466 B2 3/2010 Gaucher et al.
8,035,992 B2 10/2011 Kushta et al.
8,659,499 B1 2/2014 Pluymers
8,753,145 B2 6/2014 Lang et al.
8,952,752 B1 2/2015 Huettner
9,077,083 B1 7/2015 Freeman et al.
9,190,727 B1 11/2015 Urcia et al.
9,373,881 B2 6/2016 Thompson, Jr. et al.
9,402,301 B2 * 7/2016 Paine ..... H01R 12/72
9,490,519 B2 * 11/2016 Lilly ..... H01Q 1/50
2002/0024348 A1 2/2002 Jones et al.
2002/0037656 A1 3/2002 Murakami
2002/0139579 A1 10/2002 Kwark
2003/0020654 A1 1/2003 Navarro et al.
2003/0112200 A1 6/2003 Marino
2004/0188836 A1 9/2004 Key et al.
2005/0095896 A1 5/2005 Tutt
2005/0156802 A1 7/2005 Livingston et al.
2005/0269693 A1 12/2005 Green et al.
2006/0097947 A1 5/2006 McCarville et al.
2007/0173080 A1 7/2007 Johnson et al.
2008/0102702 A1 5/2008 Sercu et al.
2009/0197435 A1 8/2009 Jessup et al.
2009/0213562 A1 8/2009 Thevenard et al.
2009/0322620 A1 12/2009 Pedersen et al.
2010/0053026 A1 3/2010 Van Der Poel
2010/0112826 A1 5/2010 Frasco
2010/0186997 A1 7/2010 Vicich
2012/0034820 A1 2/2012 Lang et al.
2012/0146869 A1 6/2012 Holland et al.
2012/0212920 A1 8/2012 Schreffler
2012/0287581 A1 11/2012 Sauerbier et al.
2013/0003330 A1 1/2013 Chen
2013/0175078 A1 7/2013 Pai
2013/0194754 A1 8/2013 Jung et al.
2013/0314292 A1 11/2013 Maley
2013/0335931 A1 12/2013 Snider et al.
2014/0004745 A1 1/2014 Komoto et al.
2014/0152510 A1 6/2014 Manry, Jr. et al.
2014/0302807 A1 * 10/2014 Lee ..... H01Q 21/0006 455/272
2015/0028961 A1 1/2015 Carr et al.
2015/0123864 A1 5/2015 Boryssenko

FOREIGN PATENT DOCUMENTS

FR 2575336 A1 6/1986
GB 2508679 A 6/2014
JP H07-106841 4/1995
JP H11121896 A 4/1999
JP H11145648 A 5/1999
JP 2013/060037 A 4/2013
WO WO 2009/077791 A1 6/2009
WO WO 2014/168669 A1 10/2014

OTHER PUBLICATIONS

U.S. Appl. No. 13/590,769, filed Aug. 21, 2012, Kasemodel et al.
U.S. Appl. No. 14/579,568, filed Dec. 22, 2014, Viscarra.
Cavallo, et al.; "Analysis of Common-Mode Resonances in Arrays of Connected Dipoles and Possible Solutions;" Radar Conference; IEEE; Sep. 30, 2009; 4 pages.
Hees, et al.; "Ultra Broadband Dual Polarized Dipole Array with Metallic Reflector;" International Conference on Ultra Wideband; IEEE; Sep. 9-11, 2009; pp. 744-747 (4 pages).
Kasemodel, et al.; "Broadband Planar Wide-Scan Array Employing Tightly Coupled Elements and Integrated Balun;" Phased Array Systems and Technology (ARRAY) 2010 IEEE International Symposium on; Oct. 12-15, 2010; pp. 467-472 (6 pages).
Kasemodel et al.; "Broadband Array Antenna Enhancement with Spatially Engineered Dielectrics," U.S. Appl. No. 13/590,769, filed Aug. 21, 2012, 19 pages.
Kindt, et al.; "Polarization Correction in Dual-Polarized Phased Arrays of Flared Notches;" Antennas and Propagation (APSURSI); IEEE International Symposium; Jul. 3-8, 2011; pp. 1961-1964 (4 pages).
Nesic, et al.; "Wideband Printed Antenna with Circular Polarization;" Antennas and Propagation Society International Symposium; Jul. 13, 1997; pp. 1882-1885 (4 pages).
PCT International Search Report and Written Opinion of the ISA for PCT/US2014/012929 dated Apr. 28, 2014; 13 pages.
PCT International Preliminary Report of the ISA for Appl. No. PCT/US2014/012929 dated Oct. 22, 2015; 8 pages.
U.S. Appl. No. 13/859,072 Office Action dated Aug. 25, 2015, 16 pages.
U.S. Appl. No. 13/859,072 Amendment filed Nov. 24, 2015, 12 pages.

* cited by examiner

METHODS AND APPARATUS FOR ANTENNA HAVING DUAL POLARIZED RADIATING ELEMENTS WITH ENHANCED HEAT DISSIPATION

BACKGROUND

Many modern antenna applications require high bandwidth, dual polarization array antennas. Many of these applications also require low cross polarization between antenna elements. It is further desirable for the elements of an array antenna to have coincident phase centers for different polarizations to reduce the need for complicated polarization calibrations. Additionally, antenna designs should be relatively easy and low cost to manufacture. Due to size and weight constraints in some applications, it may also be desirable that antennas be lightweight and relatively low-profile.

As is known in the art, PCB-based dual polarized thumbtack antennas with coincident phase centers and a single RF port per element require an embedded power divider. At intercardinal scan and with high input power, the power divider circuit may dissipate a substantial amount of heat. Conventional thumbtack construction and interconnect provides a relatively inefficient thermal path for heat rejection. While quad-notch antennas remove the need for a power divider within the PCB eggcrate structure, these antennas requires multiple times the interconnect density. At higher frequencies packaging such a structure can become impractical.

Conventional wideband dual polarized radiators are known to have limitations in power handling. Prior attempts to address power issues include machining housings for individual boards to provide a thermal path, which requires considerable additional weight, complexity and cost. Other attempts to address power issues include using a quad notch antenna structure or an offset notch antenna structure. However, the quad notch structure requires many RF interconnects rendering it difficult to package a tight lattice. The offset notch antenna does not require the same level of thermal management but does not allow for coincident phase center dual polarized elements.

SUMMARY

Embodiments of the invention provide methods and apparatus for an array antenna including coincident phase center dual polarized radiators having enhanced heat dissipation suitable for high power applications. In embodiments, an aperture plate provides a heatsink and metal blocks on a printed circuit board (PCB) assembly provides a thermal path to a coolant manifold for heat rejection. Metal blocks with integrated spring clips can provide RF grounding and isolation between channels as well as thermal path. In illustrative embodiments of the invention, a power divider resistor is bonded directly to the metal blocks to mitigate thermal rise within the PCB substrate. An eggcrate structure is secured to the aperture plate by a fastener, such as a countersunk screw, that can also contribute to thermal performance and ground plane connection. In embodiments, spring clips can provide contact between the metal blocks and the aperture plate. Spring probe interconnects provide RF connection to the PCBs of the eggcrate structure and retain the structure of the aperture plate.

In one aspect of the invention, an array antenna comprises: a plurality of radiating elements on a first layer thereof, the plurality of radiating elements including elements that are driven in a balanced fashion; an eggcrate structure below the first layer, the eggcrate structure comprising a plurality of first dielectric panels arranged in a first orientation and a plurality of second dielectric panels arranged in a second orientation and interconnected with the plurality of first panels; at least one balun disposed on at least one of the dielectric panels of the egg create structure for use in feeding at least one of the radiating elements in the plurality of radiating elements, an aperture plate from which the first and second dielectric panels extend, wherein the aperture plate provides a connection of the first and second dielectric panels to a ground plane for the antenna; metal blocks secured onto ones of the first and second dielectric panels, wherein the metal blocks form a part of the ground plane of the antenna, a heatsink for the antenna, and a RF shield; a power divider resistor for the at least one balun coupled directly to one of the metal blocks to form a thermal path to the aperture plate; and a plurality of spring probe interconnects disposed in the aperture plate to provide respective RF connections to respective ones of the first and second dielectric panels.

The antenna can further include one or more of the following features: the antenna includes coincident phase center dual polarized radiators, spring gaskets coupled onto the metal blocks, wherein compression of the spring gaskets provides thermal paths to the metal blocks and the aperture plate, an attachment mechanism to secure the eggcrate structure to the aperture block, the attachment mechanism comprises metal and forms part of the ground plane, multiple baluns disposed on multiple dielectric panels of the eggcrate structure for use in feeding multiple radiating elements in the plurality of radiating elements, some of the multiple baluns feed corresponding antenna elements in a first polarization direction and some of the multiple baluns feed corresponding antenna elements in a second polarization direction that is orthogonal to the first polarization direction, and/or the plurality of first dielectric panels and the plurality of second dielectric panels define a plurality of open regions within the eggcrate structure, wherein the metal blocks at least partially fill corresponding open regions in the eggcrate structure.

In another aspect of the invention, a method comprises: employing a plurality of radiating elements for an array antenna disposed on a first layer thereof, the plurality of radiating elements including elements that are driven in a balanced fashion; employing an eggcrate structure below the first layer, the eggcrate structure comprising a plurality of first dielectric panels arranged in a first orientation and a plurality of second dielectric panels arranged in a second orientation and interconnected with the plurality of first panels; employing at least one balun disposed on at least one of the dielectric panels of the egg create structure for use in feeding at least one of the radiating elements in the plurality of radiating elements; employing an aperture plate from which the first and second dielectric panels extend, wherein the aperture plate provides a connection of the first and second dielectric panels to a ground plane for the antenna; employing metal blocks secured onto ones of the first and second dielectric panels, wherein the metal blocks form a part of the ground plane of the antenna, a heatsink for the antenna, and a RF shield; employing a power divider resistor for the at least one balun coupled directly to one of the metal blocks to form a thermal path to the aperture plate; and employing a plurality of spring probe interconnects disposed in the aperture plate to provide respective RF connections to respective ones of the first and second dielectric panels.

The method can further include one or more of the following features: the antenna includes coincident phase center dual polarized radiators, spring gaskets coupled onto the metal blocks, wherein compression of the spring gaskets provides thermal paths to the metal blocks and the aperture plate, an attachment mechanism to secure the eggcrate structure to the aperture block, the attachment mechanism comprises metal and forms part of the ground plane, the at least one balun includes multiple baluns disposed on multiple dielectric panels of the egg create structure for use in feeding multiple radiating elements in the plurality of radiating elements, some of the multiple baluns feed corresponding antenna elements in a first polarization direction and some of the multiple baluns feed corresponding antenna elements in a second polarization direction that is orthogonal to the first polarization direction, and/or the plurality of first dielectric panels and the plurality of second dielectric panels define a plurality of open regions within the eggcrate structure, wherein the metal blocks at least partially fill corresponding open regions in the eggcrate structure.

BRIEF DESCRIPTION OF THE DRAWINGS

The foregoing features of this invention, as well as the invention itself, may be more fully understood from the following description of the drawings in which.

DETAILED DESCRIPTION

Figure 1:
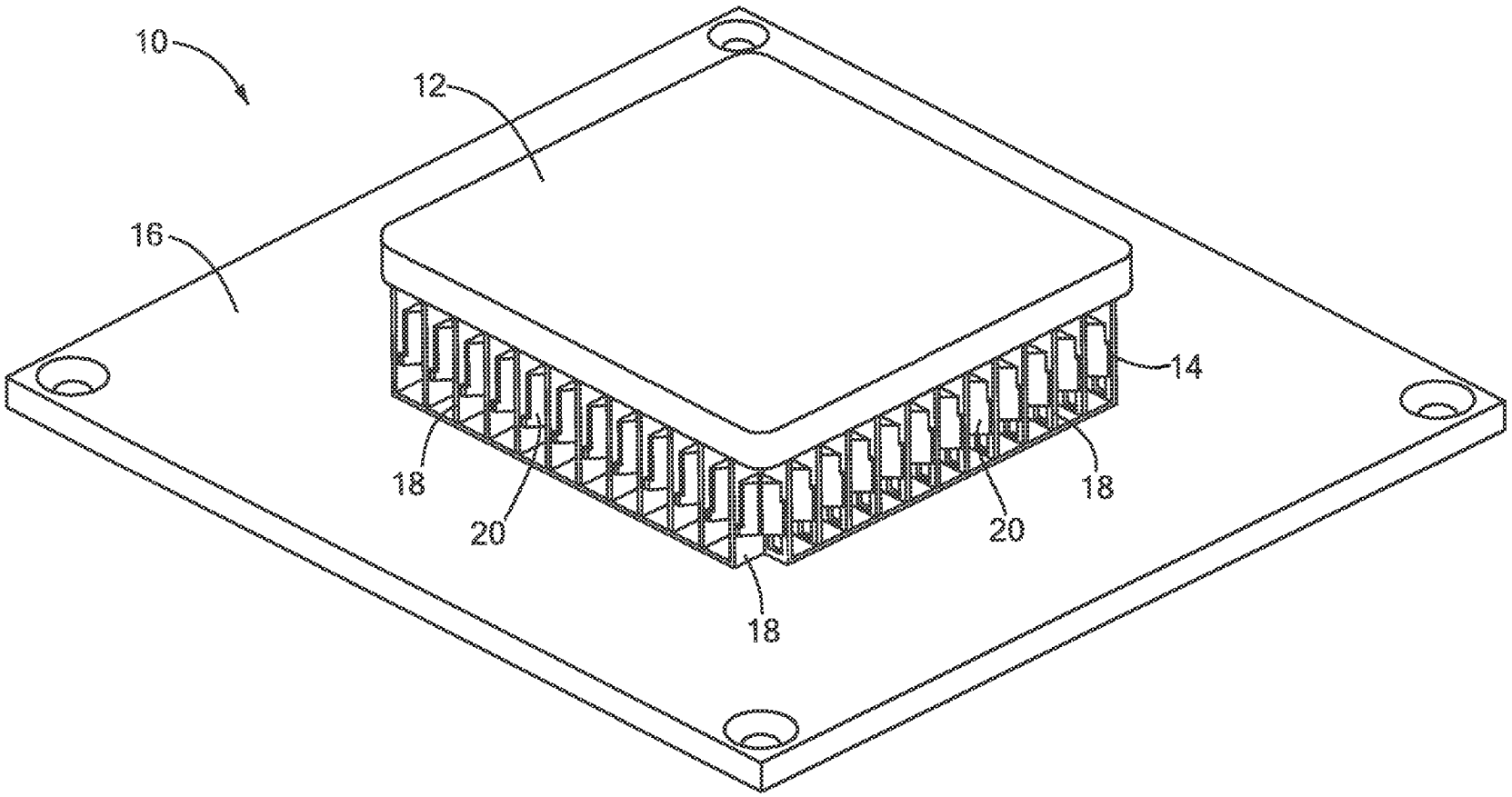
FIG. 1 is a diagram illustrating an exemplary dual polarized, co-phase centered array antenna in accordance with an embodiment.

FIG. 1 is a diagram illustrating an exemplary dual polarized, co-phase centered array antenna 10 having enhanced heat dissipation in accordance with an embodiment. The array antenna 10 is capable of operation in multiple different polarizations at relatively high bandwidth. The array antenna 10 is relatively easy and inexpensive to fabricate using printed circuit technology and can be made very low profile. The array 10 is capable of providing coincident phase centers at the element level and is also capable of operation with low cross polarization, thereby reducing the need for complicated polarization calibration and increasing instantaneous phased array calibrated bandwidths. The array antenna 10 is well suited for multi-function radar and communications applications, as well as many other applications.

As illustrated in FIG. 1, array antenna 10 may comprise a planar aperture 12 that is formed over an eggcrate structure 14. The eggcrate structure 14 may be removably or permanently attached to a support structure 16. The support structure 16 may include, for example, a mounting plate, an outer surface of a vehicle or aircraft, or any other structure capable of supporting the antenna during operation. The planar aperture 12 may include, among other things, an array of radiating elements (not shown in FIG. 1) and a radome covering the radiating elements. The eggcrate structure 14 may include a plurality of dielectric ribs or panels 18 that are interconnected with one another to provide a base for the planar aperture 12. As will be described in greater detail, the eggcrate structure 14 may, in some implementations, include circuitry for feeding the radiating elements as well as structures for providing shielding and a ground plane for the antenna array. The dielectric panels 18 may, for example, have balun circuitry disposed thereon for use in providing a balanced feed for the radiating elements. In addition, in some embodiments, ground plane blocks 20 may be attached to the dielectric panels 18 of the eggcrate structure 14 to form a ground plane for the antenna. The blocks 20 may also provide shielding for circuits within the array assembly.

In the embodiment illustrated in FIG. 1, array antenna 10 is configured for use in a frequency band having a 4:1 bandwidth. The antenna design can be modified for use in a wide variety of different frequency ranges. The array antenna 10 has a low profile of 1.287 inches for the assembly including the planar aperture 12 and the eggcrate structure 14 (1.537 inches with the support plate). The spacing between the unit cells of the array is 0.330 inches in each dimension. In the illustrated embodiment, the array antenna 10 is a square array with a dimension of 4.26 inches per side and includes 12 unit cells in each dimension. Other shapes, sizes, and number of unit cells may be used in other implementations.

Figure 2:
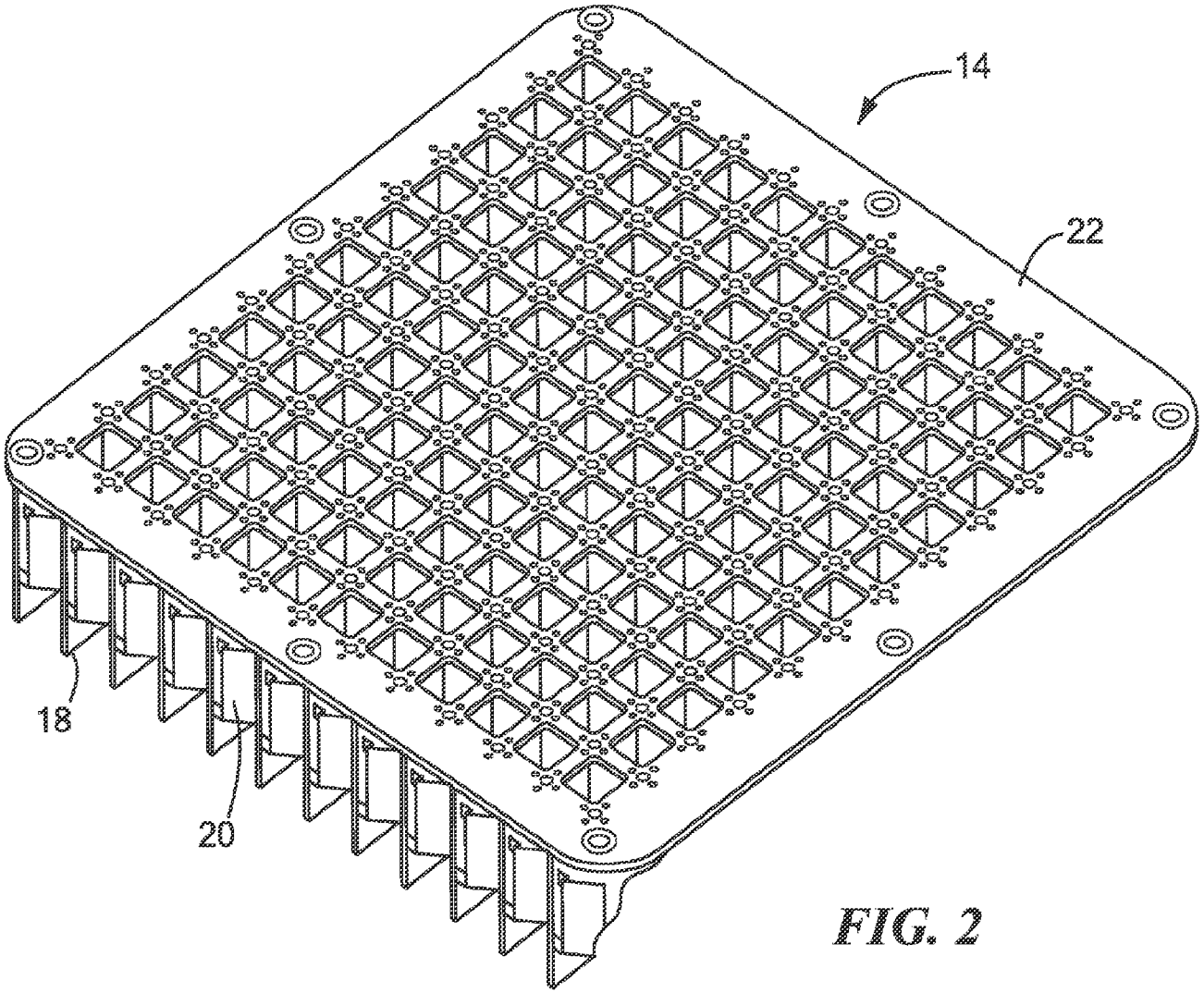
FIG. 2 is a perspective view of an exemplary eggcrate structure that may be used in the array antenna of FIG. 1 in accordance with an embodiment.

FIG. 2 is a perspective view of an exemplary eggcrate structure 14 that may be used in the array antenna 10 of FIG. 1 with the planar aperture 12 removed. The dielectric panels 18 of the eggcrate structure 14 may be interconnected in a manner that forms a grid. That is, some of the dielectric panels 18 may have a first orientation (e.g., vertical) and some of the dielectric panels 18 may have a second, orthogonal orientation (e.g., horizontal). Other configurations for interconnecting the panels may alternatively be used. A face sheet 22 may be installed over the interconnected panels 18. The face sheet may be made from, for example, a dielectric board material (e.g., Rogers 4003 manufactured by Rogers Corporation, etc.), but other material types may alternatively be used. Among other things, the face sheet 22 may serve to hold the panels 18 together in their desired configuration. As will be described in greater detail, the face sheet 22 may also have transmission structures disposed thereon for use in feeding antenna elements within the planar aperture 12.

Alternatively, these transmission structures may be placed on another dielectric layer that is placed over the face sheet.

Figure 3:
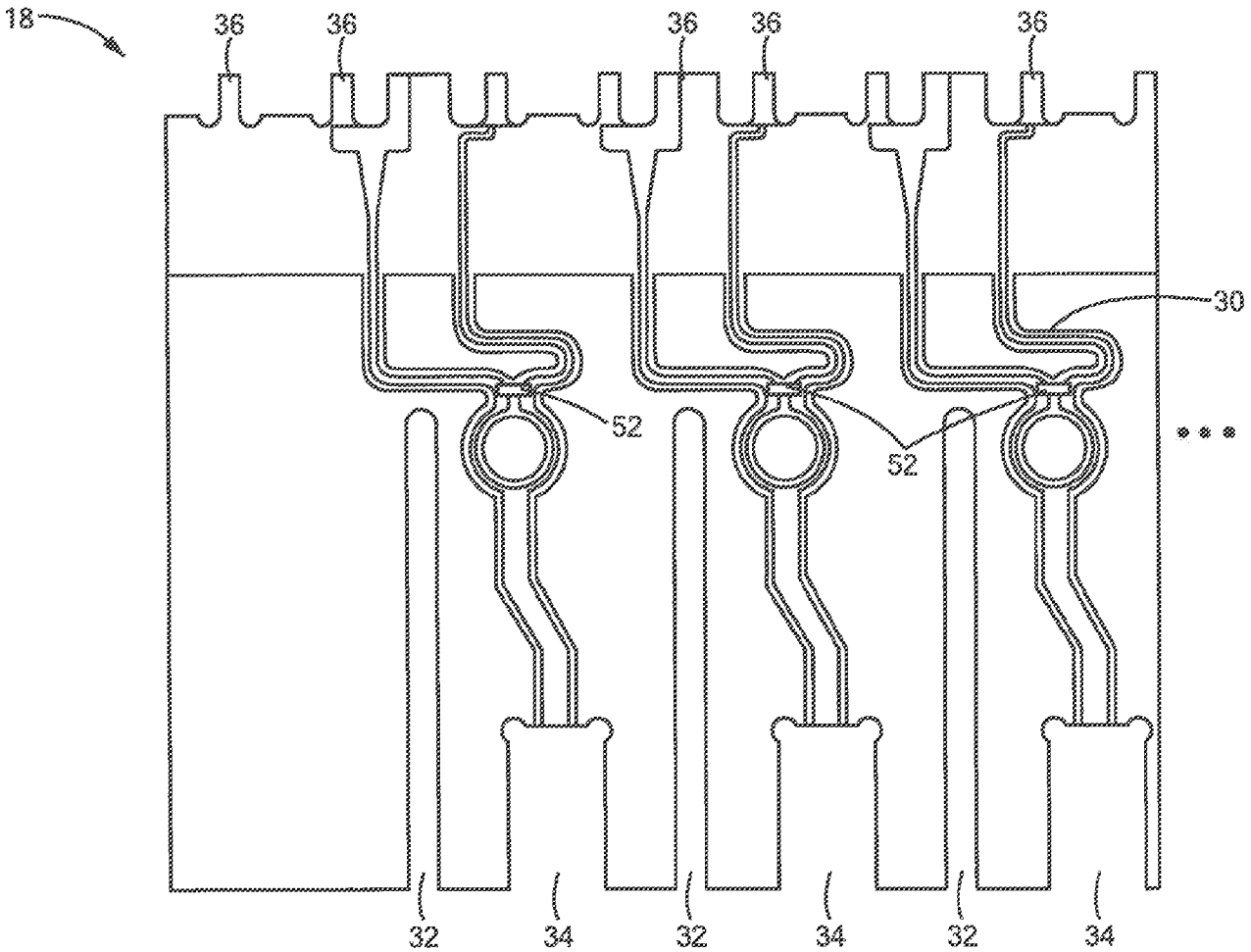
FIG. 3 is a side view of a portion of an exemplary dielectric panel that may be used in an eggcrate structure in accordance with an embodiment.

FIG. 3 is a side view of a portion of an exemplary dielectric panel 18 in accordance with an embodiment. As shown, the dielectric panel 18 includes balun circuitry 30 disposed on a surface thereof and an isolation resistor 52. Slots 32 may be formed in the dielectric panels 18 to facilitate interconnection of the panels. Panels to be used in a first orientation may have slots 18 along a bottom edge of the panel, while panels to be used in a second orientation may have slots 18 along a top edge of the panel. The panels may then be interconnected by coupling together the various slots. In some embodiments, voids 34 may also be provided in the panels 18 for installation of connectors for use in connecting the array antenna to external circuitry (e.g., an external beamformer, external transmit and/or receive circuitry, etc.). In some implementations, no connectors or voids 34 may be used. Any type of dielectric board material may be used for the dielectric panels 18. In one implementation, a 0.02 inch thick dielectric board manufactured by Rogers Corporation (Rogers 4003) is used for the panels 18.

The dielectric panels 18 may also include projections 36 along an upper edge thereof for use in coupling the panels to a face sheet (e.g., face sheet 22 of FIG. 2). During antenna assembly, the projections 36 may be inserted into openings in the face sheet and secured in place. In one possible approach, different panels 18 of the antenna may first be assembled together and then the face sheet may be placed over the panels 18 so that the openings in the face sheet fit over the corresponding projections 36. Solder or an adhesive (e.g., conductive epoxy, etc.) may then be used to secure the projections 36 to the face sheet using, for example, a low cost planar process. The solder or adhesive may be applied to an upper surface of the face sheet in some implementations (i.e., the side opposite the side where the panels are located). In another technique, the dielectric panels 18 may be inserted into the face sheet one at a time, with the panels 18 having slots 32 on the bottom edge being inserted first and then the panels having slots on the top edge. The panels 18 may be secured to the face sheet as they are inserted or in a single step after all panels have been inserted. This technique of applying solder or conductive adhesive to the face sheet obviates the need to solder or epoxy the unit cell panels/ribs together at the seams to provide structural integrity. Other assembly procedures may alternatively be used. In some embodiments, the projections 36 may be metalized to facilitate attachment and/or electrical connection.

Figure 4:
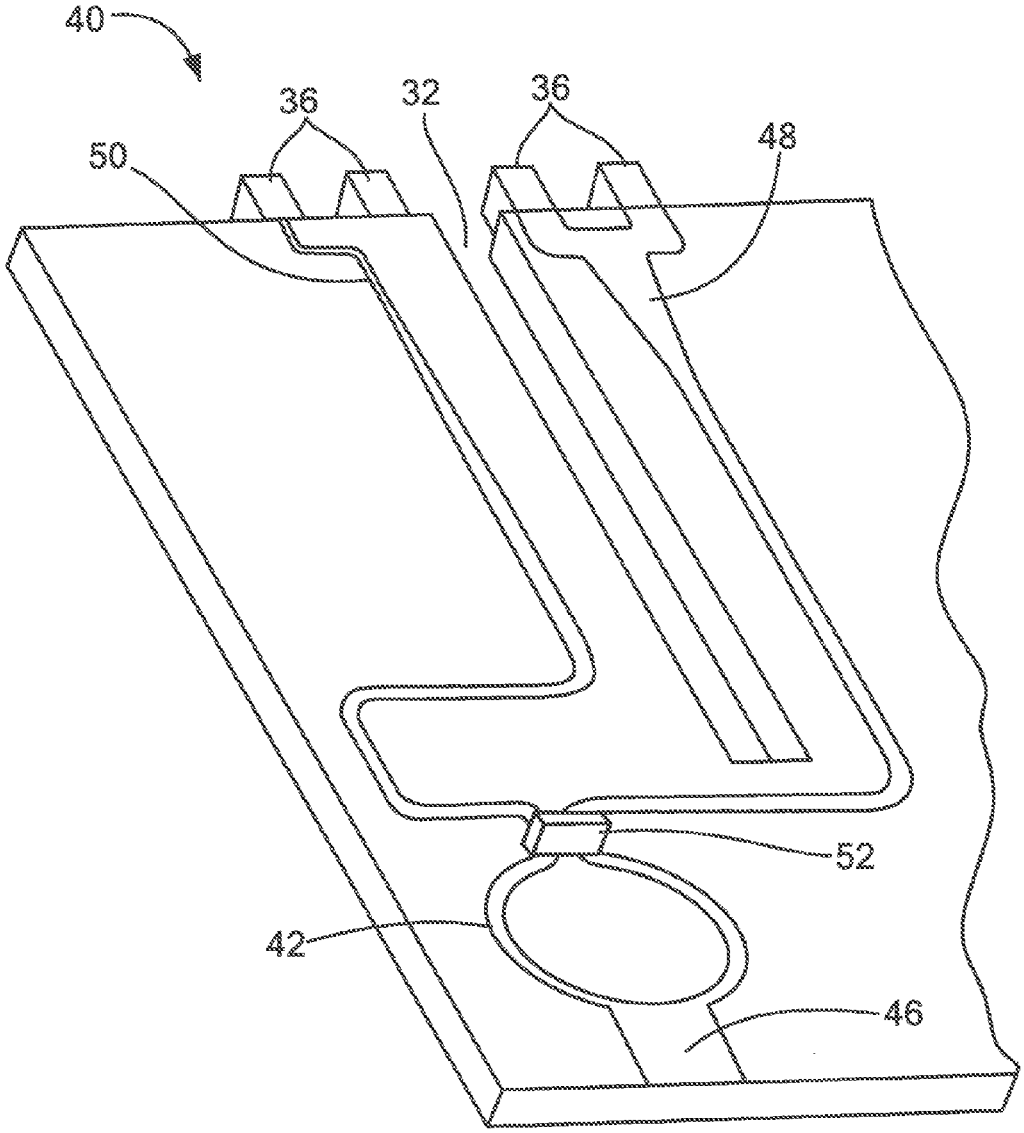
FIG. 4 is a diagram illustrating a portion of another exemplary dielectric panel in accordance with an embodiment.
Figure 4A:
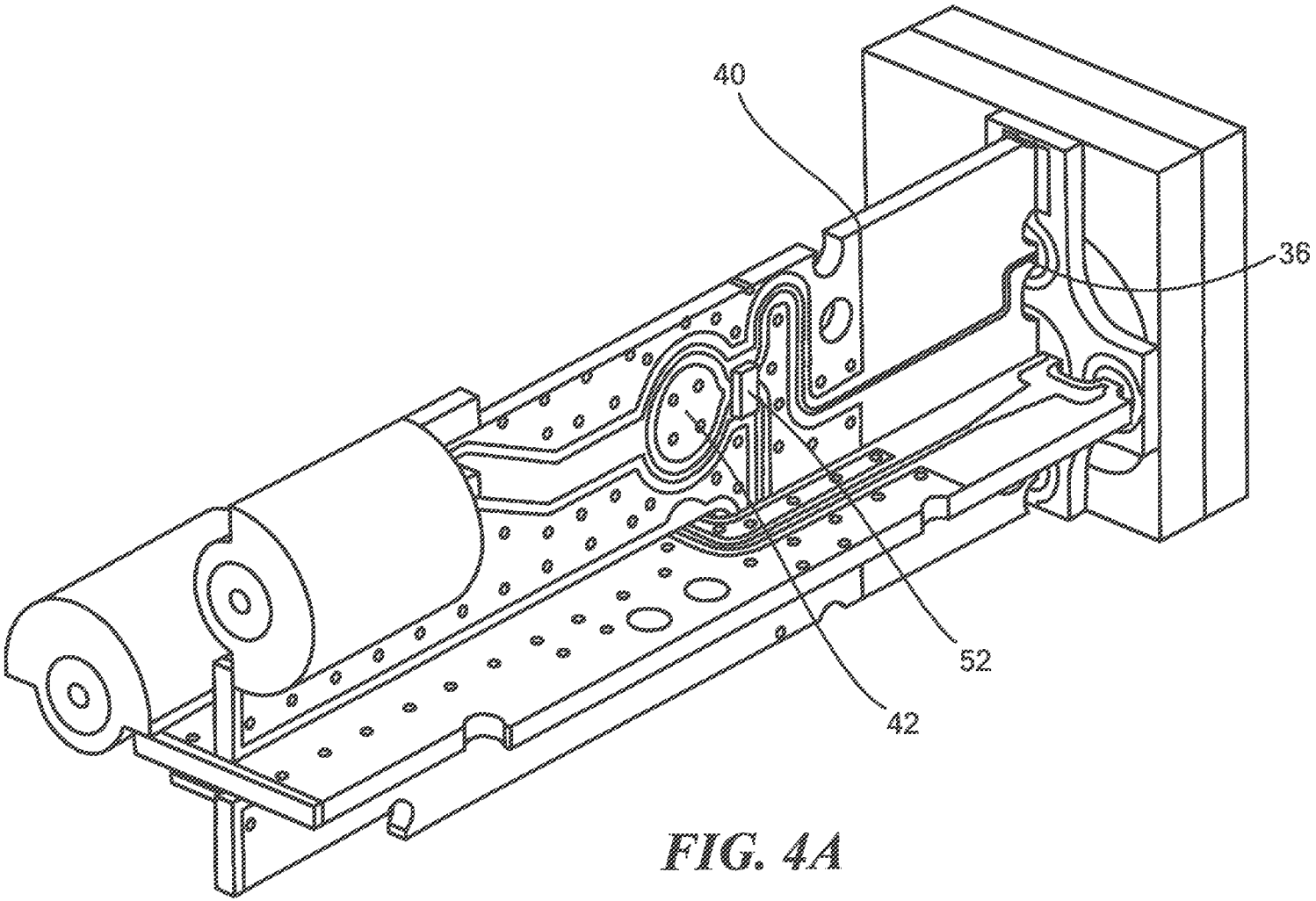
FIG. 4A is a schematic representation of a thumbtack radiator embodiment.

FIGS. 4 and 4A show a portion of another exemplary dielectric panel 40 in a dual polarized thumbtack configuration. As shown, the dielectric panel 40 of FIG. 4 may include slots 32 along an upper edge thereof. As described above, these slots 32 may engage with slots along the lower edge of other panels (see FIG. 3) during antenna assembly. Dielectric panel 40 includes balun circuitry 42 disposed thereon for use in coupling balanced signals to and/or from a corresponding antenna element of a planar array. As is well known, a balun is a type of transformer that transforms between balanced and unbalanced (or single-ended) signals. Balun circuitry 42 includes a balanced port 44 to be coupled to the antenna element and a single-ended port 46 to be coupled to external circuitry (e.g., an external beamformer, external transmit and/or receive circuitry, etc.). The balun circuitry 42 may operate in both directions in some embodiments. That is, the balun circuitry 42 may convert single-ended signals to balanced signals during transmit operations and balanced signals to single-ended signals during receive operations. In some embodiments, the balun circuitry 42 may only operate in a single direction (e.g., when the array antenna is being used as transmit only antenna or a receive only antenna, etc.).

Dielectric panel 40 may include any type of balun circuitry that is capable of implementation within the available space of a dielectric panel. In at least one embodiment, a balun design is used that includes circuitry disposed on both sides of the dielectric panel 40. Balun circuit 42 on dielectric panel 40 includes, for one of its balanced feed lines, a tapered transmission line segment 48 on an upper surface of panel 40 and another tapered transmission line segment on a lower surface of panel 40 (not shown) that is a rotated mirror image of tapered segment 48. FIG. 7, described below, illustrates the rotated mirror image transmission line segments in greater detail. This geometry taper is used to flip the polarity of the signal on the balanced line. For the other balanced feed line 50, balun circuit 42 also uses transmission line impedance tapering to provide an impedance match in the antenna (e.g., an impedance taper from 200 to 377 ohms in the illustrated embodiment). This transmission line impedance taper consists of a narrowing of the center conductor of the transmission line structure 50 as it approaches the corresponding projection 36. A similar taper may also be provided on the transmission line segment on the lower surface of dielectric panel 40 (e.g., a taper from 200 to 377 ohms at the end of the rotated mirror image of segment 48). The purpose of these transmission line tapers may be to more accurately match the free space wave impedance seen by the antenna. The balun circuit 42 may also include a ground plane region over a portion of the bottom surface of dielectric panel 40. This balun circuit design is capable of operation over a multiple octave bandwidth.

The balun circuit 42 also includes an isolation resistor 52 across the output lines thereof. It has been found that this isolation resistor improves the voltage standing wave ratio (VSWR) pull over scan and power handling. In at least one embodiment, a thick film chip resistor (e.g., a 200 ohm 0402 resistor) having a diamond substrate is used as isolation resistor 52, although other types of resistors may alternatively be used.

In general, the isolation resistor should be rated for the wattage dissipation required for the application for which the radiator will be used. For higher power applications, chip resistors available of various materials to provide the necessary thermal characteristics can be selected to meet the needs of a particular application. In illustrative embodiments, the isolation resistor is mounted down to the metal block for providing an enhanced thermal path for allowing optimal heat transfer and allowing the isolation resistor to provide thermal dissipation up to the rating of the resistor.

In conventional configurations, the resistor was flipped and not mounted to metal, but instead attempted to provide a thermal path through the printed circuit board, which may not be an efficient thermal path as compared to embodiments of the invention. For conventional flipped configurations, and for other implementations not mounted efficiently to the thermal path, the resistor may not provide thermal dissipation up to its rating due to the lack of an efficient thermal path to remove the heat.

Figure 4B:
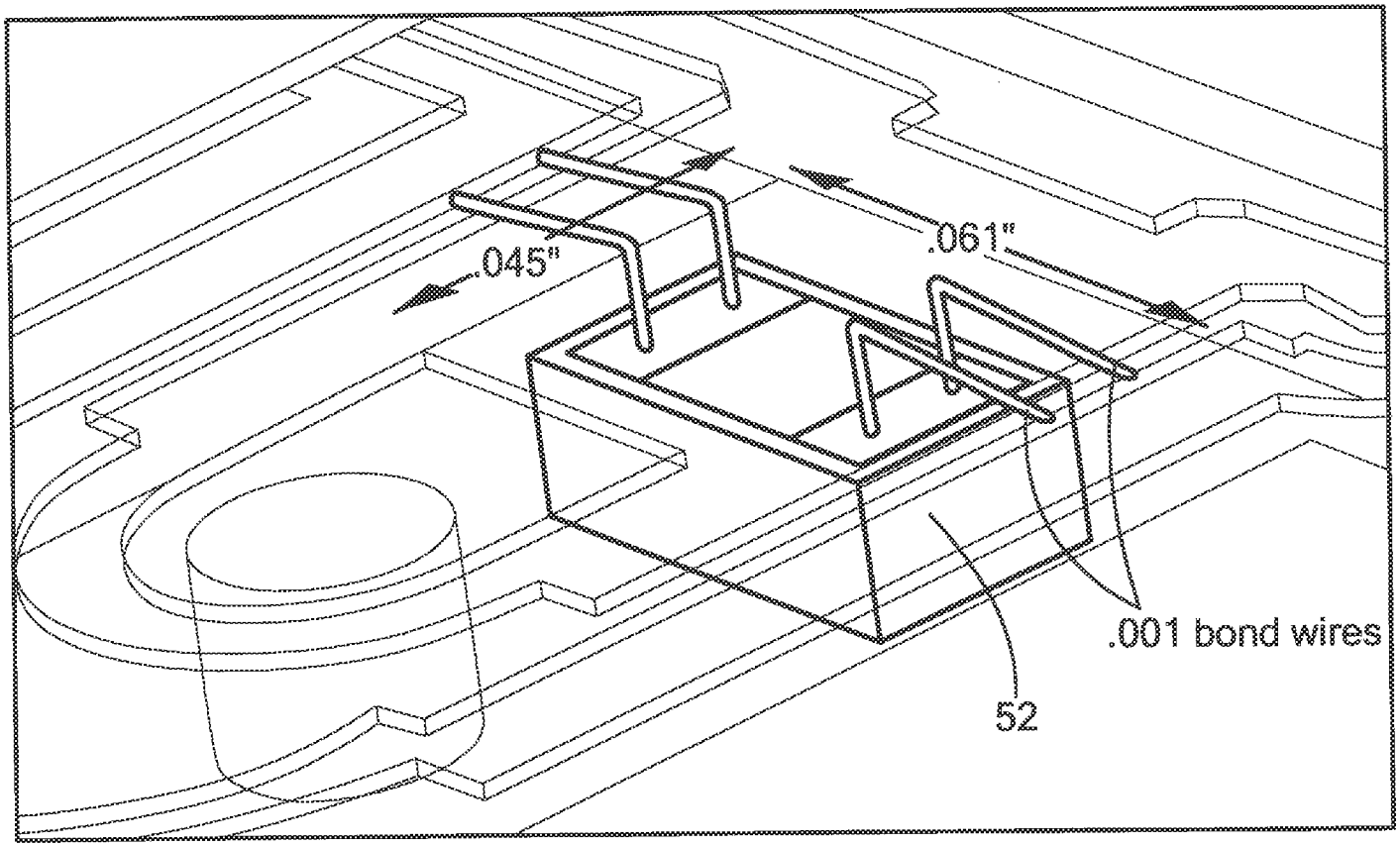
FIG. 4B is a schematic representation of a power divider resistor for the thumbtack radiator of FIG. 4A

FIG. 4B shows an illustrative embodiment and dimensions for an isolation resistor 52 coupled to the ground blocks. In the illustrated embodiment, a film side of the resistor faces up and the resistor is bonded to the ground block using solder. The configuration employed in this embodiment provides an improved thermal path, order of magnitude better, due to the increased contact area between the metal ground block and the metal film on the bottom face of the resistor than the conventional installation in which the film side of the resistor faces down and the resistor is mounted to PCB.

The illustrative embodiment provides a dual thumbtack antenna with coincident phase centers and a single RF port per element with a resistor 52 dissipating significantly more heat than conventional comparable antennas. As described above, the resistor 52 is bonded directly to the metal blocks to mitigate thermal rise within the PCB substrate. Illustrative bonding materials include ABLEBOND 1B8175, solder (AuSn eutectic, SnPb, etc), and the like. In embodiments, the resistor 52 can be wirebonded to the circuit assembly.

Referring again to FIGS. 4 and 4A, the dielectric panel 40 may include projections 36 on an upper edge thereof for insertion into openings of a face sheet, as described previously. Some of the projections 36 may have transmission line structures disposed thereon that may be conductively coupled to transmission line structures on the face sheet (or on another dielectric layer placed over the face sheet) when the projections 36 are secured in place. As described previously, in one approach, the dielectric panels may be secured in place using solder or conductive epoxy. Both of these technique may provide conductive coupling between the transmission line segments on the projections 36, if any, and the transmission line segments on the face sheet. The transmission line segments on at least some of the projections 36 may include the balanced signal lines associated with the balun circuitry 42. Balanced signal line 50 may be coupled to a projection 36 on an upper surface of panel 40. The other balanced signal line may be coupled to a projection 36 on the underside of the panel 40. A ground connection may also be made between the upper surface and the lower surface of panel 40 across one of the projections 36 (or in some other location).

Figure 5:
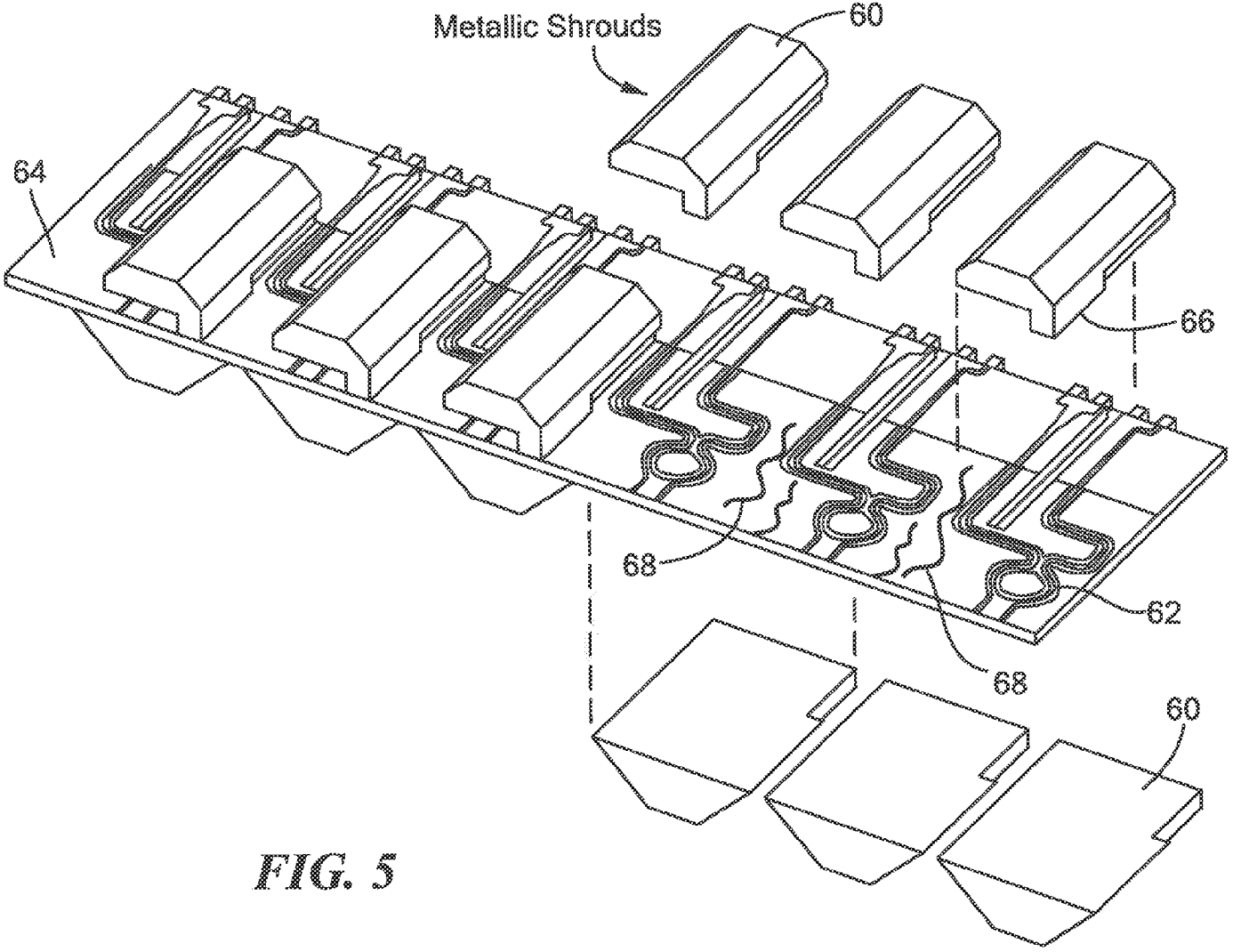
FIG. 5 is a diagram illustrating a technique for attaching ground plane blocks to dielectric panels in accordance with an embodiment.

As described previously, in some embodiments, ground plane blocks are attached to the dielectric panels of the eggcrate structure to provide a ground plane for the antenna and to provide RF shielding. FIG. 5 is a diagram illustrating one technique for attaching the ground plane blocks to the panels. As illustrated, the ground plane blocks 60 may be connected into positions above some or all of the balun circuitry 62 on a dielectric panel 64. The ground plane blocks 60 may include spacer structures 66 for preventing the blocks 60 from contacting (and potentially shorting) the balun circuitry 62 (or other circuitry) on the panel 64. In one attachment technique, conductive epoxy 68 may first be placed on the panel 64 in a location having ground metallization. The spacer structures 66 of the ground plane blocks 60 may then be pressed onto the conductive epoxy 68 and allowed to cure. Other attachment techniques may alternatively be used.

Figure 6:
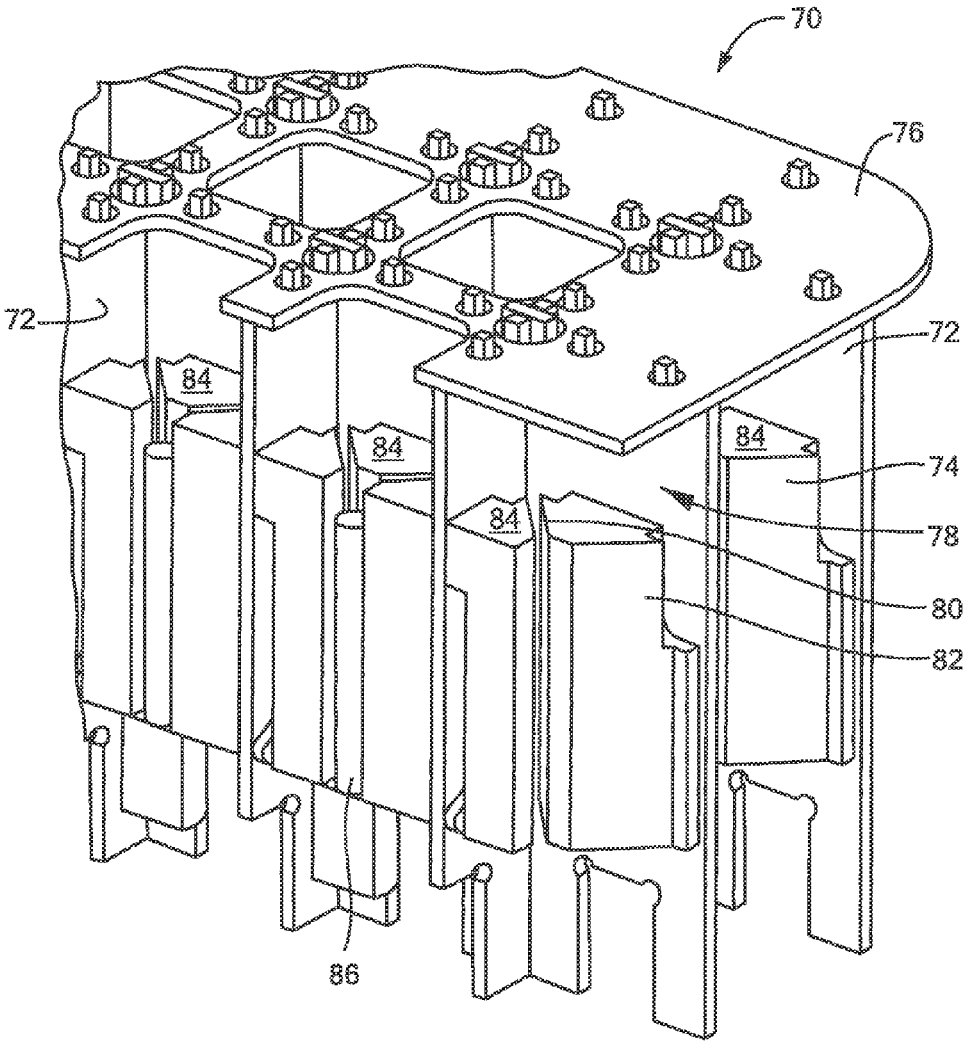
FIG. 6 is a sectional view of an assembly having dielectric panels with ground plane blocks connected together into an eggcrate structure with a face sheet attached thereto in accordance with an embodiment.

FIG. 6 is a sectional view of an exemplary assembly 70 having dielectric panels 72 with ground plane blocks 74 connected together into an eggcrate structure with a face sheet 76 attached thereto in accordance with an embodiment. As shown, when the panels 72 are interconnected, they define a plurality of open regions 78 that are generally rectangular (e.g., square) in shape (although other shapes may exist in other embodiments). The ground plane blocks 74 fill a portion of these open regions 78. As illustrated, in some embodiments, the ground plane blocks 74 may each have two sloped surfaces 80, 82 that allow the ground plane blocks 74 to fit closely together within the open regions 78 of the eggcrate structure. These sloped surfaces may, for example, be close to and parallel with sloped surfaces 80, 82 of other ground plane blocks within an open region 78 so that a large level of fill may be achieved. In an embodiment that has rectangular open regions 78, the sloped surfaces 80, 82 of the ground plane blocks 74 may form 45 degree angles with the surfaces of the panels 72 the blocks 74 are mounted on. Other angle schemes may alternatively be used.

As shown in FIG. 6, when used, the ground plane blocks 74 may collectively form a ground surface 84 that forms a ground plane for the array antenna. This ground plane may dispense with the need to provide a separate ground back plane layer for the antenna. The ground plane blocks 74 may also provide shielding for the circuitry on the dielectric panels 72 to prevent, for example, cross-talk between the panels and/or undesired coupling between the panels and the antenna elements. As illustrated in FIG. 6, in some implementations, an elongated member of electromagnetic energy absorbing material 86 (e.g., Eccosorb®, etc.) may be inserted into a space between the ground plane blocks 74 to prevent electromagnetic resonance effects that might occur in the region (e.g., a cavity resonance effect that could draw energy away from the radiating elements).

In some embodiments, instead of four ground plane blocks 74 in an open region 78, a single large ground plane block attached to one of the corresponding panels may be used to fill most of the desired area. In another approach, two ground plane blocks may be attached to opposing panels that each fill one half of the desired area (or some other ratio, such as 60/40) within the open region 78. In some embodiments, the ground plane blocks are metallic (e.g., aluminum, copper, etc.), although other materials and material combinations may be used in other embodiments (e.g., plated dielectric materials, etc.).

Figure 6A:
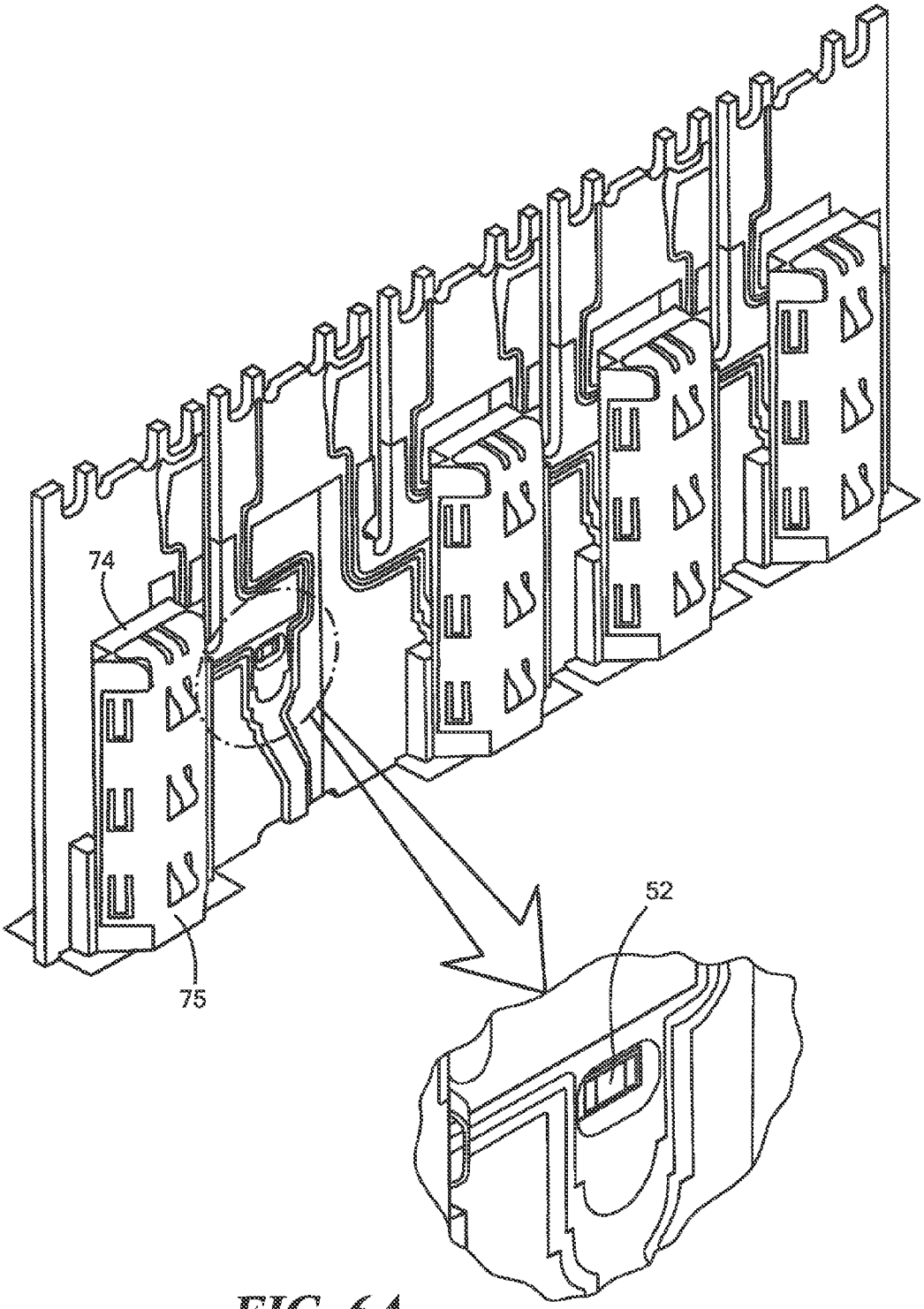
FIG. 6A is a schematic representation of spring clips over ground plane blocks.

FIG. 6A shows ground plane blocks 74 covered by spring clips 75 that provide electrical and thermal connections, as described more fully below. The isolation resistor 52 is shown in a cavity or through-hole formed in the circuit assembly/dielectric panels.

As described above, in some embodiments, balanced transmission line structures will be coupled to some of the projections on a dielectric panel of an eggcrate structure that will be conductively coupled to other transmission structures on a surface of the face sheet or another dielectric layer above the face sheet. The transmission structures on the face sheet, or on the other dielectric layer above the face sheet, act as feeds for the antenna elements of the antenna array. In at least one embodiment, the antenna elements of the array antenna are formed from parasitic tiles elements that are on another layer of the antenna than the transmission structures on the face sheet (or the dielectric layer above the face sheet). In these embodiments, the transmission structures are coupled to the parasitic tile elements by non-conductive coupling.

Figure 7A:
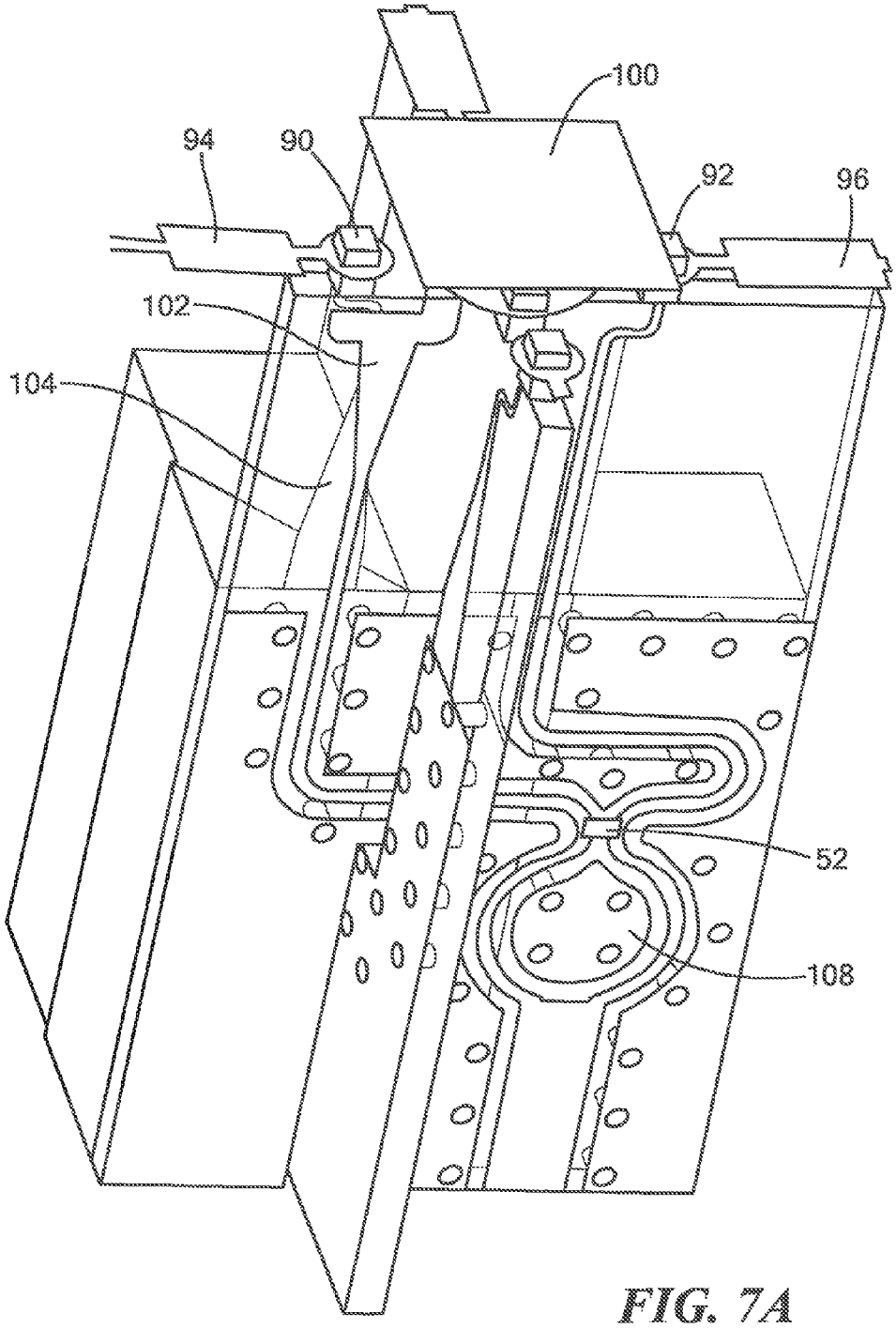
FIG. 7A is a diagram illustrating a portion of an array antenna that uses transmission line segments to feed slots formed between parasitic tiles in accordance with an embodiment.

FIG. 7A is a diagram illustrates an embodiment having projection 90 and projection 92 conductively coupled to transmission line segment 94 and transmission line segment 96 on the face sheet. The transmission line segments may then serve as non-conductive feeds for slots formed between parasitic tile elements 100 on a higher layer. A similar approach may be used in the orthogonal direction to feed slots between tile elements 100 (to achieve dual polarization). In this manner, antenna elements having coincident phase centers may be achieved. This same approach may be used with some or all of the other elements in the array. In other embodiments, other types of radiating elements may be used, including conductively fed elements. As shown in FIG. 7A, in some embodiments, co-planar waveguide (CPW) may be used to implement the balun circuitry 108 on the dielectric panels. FIG. 7A also shows the rotated mirror image transmission line segments 102, 104 associated with one of the balanced feed lines of the balun circuit 108 in an embodiment.

Figure 7B:
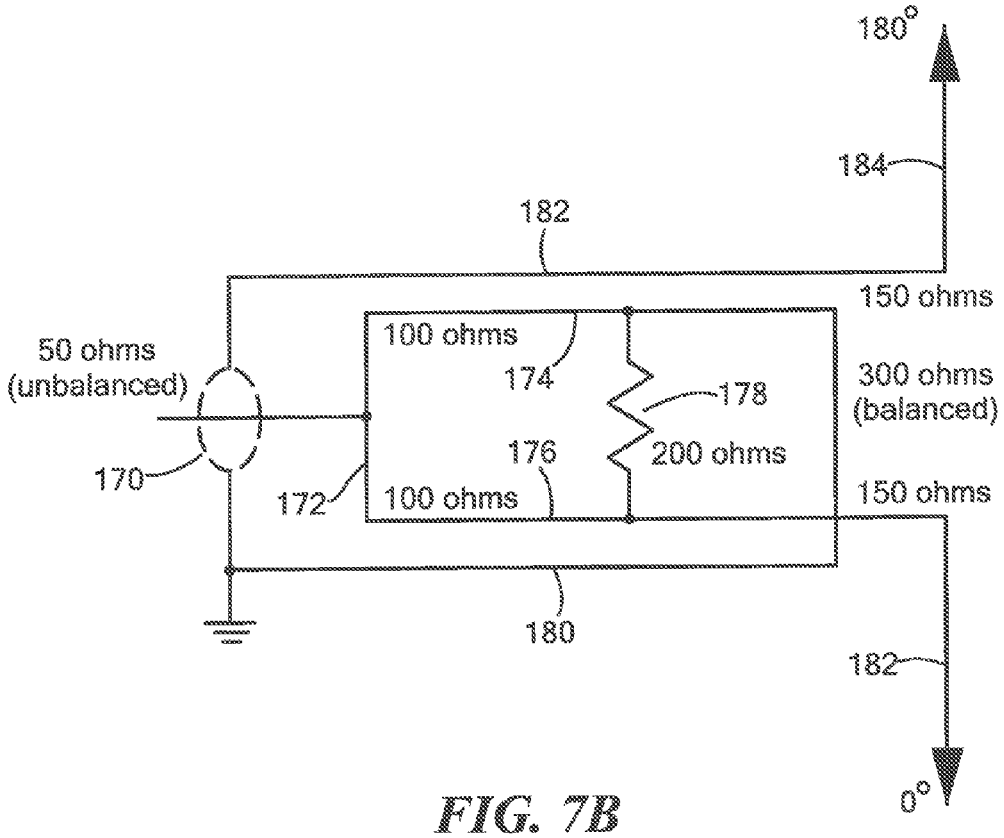
FIG. 7B is a schematic diagram illustrating electrical characteristics of a balun circuit shown in FIG. 7A in accordance with an embodiment.

FIG. 7B is a schematic diagram illustrating electrical characteristics of the balun circuit 108 of FIG. 7A in accordance with an embodiment. With reference to FIG. 7B, an unbalanced, 50 ohm port 170 feeds into a splitter structure 172 that splits the signal into two 100 ohm lines 174, 176. A 200 ohm resistor 178 is coupled across the lines 174, 176. Line 176 is coupled directly out to a transmission line segment on the face sheet (e.g., transmission line segment 96 in FIG. 7A). This line represents the 0-degree phase line of the balanced output signal. Line 174, on the other hand, is first coupled to a ground structure 180 on the lower surface of the dielectric panel. A transmission structure 182 on the lower surface of the panel, which is directly under line 174, is then coupled out from the ground structure to a different transmission line segment on the face sheet (e.g., transmission line segment 94 in FIG. 7A). This line represents the 180-degree phase line of the balanced output signal. Transmission line 174 on the upper surface of the dielectric panel and transmission segment 182 on the lower surface of the dielectric panel represent the rotated mirror image transmission line segments 102, 104 of FIG. 7A. As described previous, these rotated mirror image transmission line segments 102, 104 are used to flip the polarity of the signal on the second output line.

Figure 8:
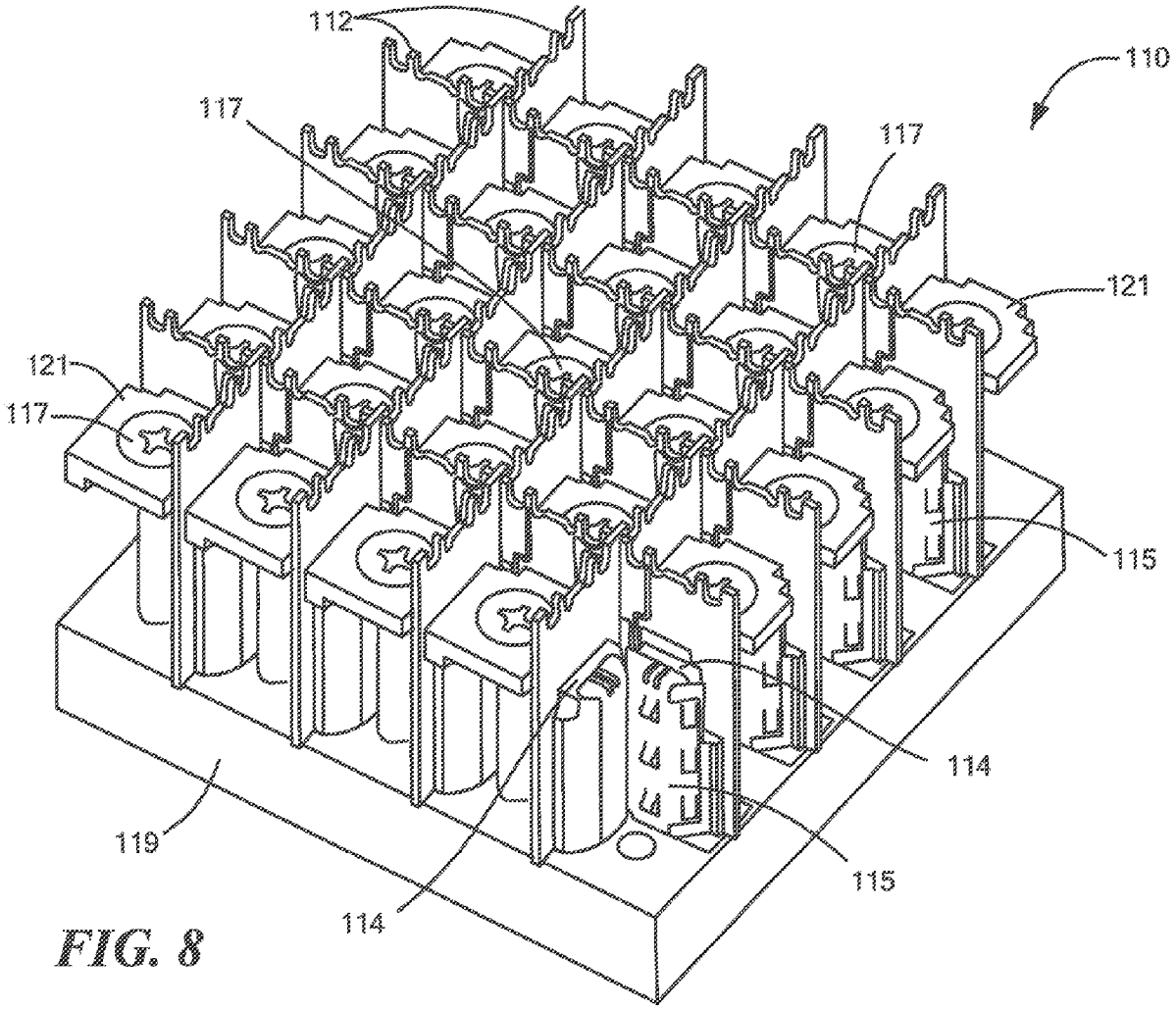
FIG. 8 is a perspective view of a portion of an array antenna having an eggcrate structure in accordance with an embodiment.

FIG. 8 is a perspective view of a portion of an array antenna 110 having a thumbtack radiator configuration with enhanced power dissipation in accordance with an embodiment. As illustrated, the array antenna 110 has dielectric panels 112 including resistors 111 (FIG. 8A) mounted on the ground plane blocks 114, which are covered by spring clips 115 and assembled into an eggcrate structure. Screws 117 secure the thumbtack structure to an aperture plate 119.

Figure 8A:
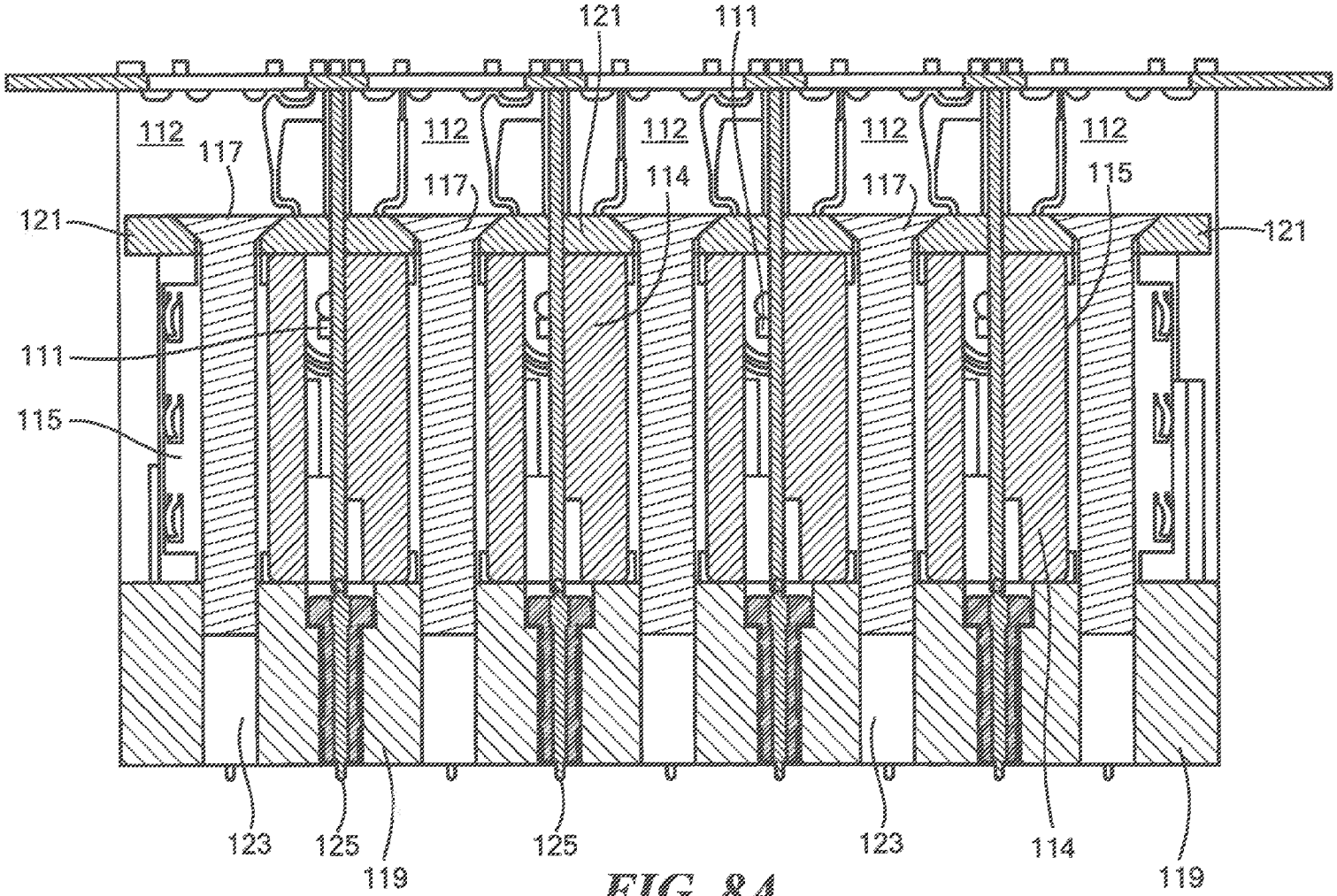
FIG. 8A is a cross-sectional view of the array antenna of FIG. 8.

FIG. 8A is cross-sectional view of the antenna of FIG. 8 showing the countersunk screws 117 impinging on a ground cube 121. Spring gaskets 123 provide RF ground to the ground cube 121, screws 117, and aperture plate 119. Spring clips 115 are forced against the ground plane blocks 114 by the screws 117. Spring probe interconnects 125 provide solderless electrical connection from the panels 112 to an external system.

RF grounding and isolation are provided by the thermally and electrically conductive RF shield of the ground plane blocks 114 and the spring clips 115. The thumbtack assembly is thermally coupled to the aperture plate 119 by compression of the spring clips 115 between the RF shield and the aperture plate.

In addition, there exists a parallel thermal path from the ground plane blocks 114 through the RF shield 115, into the ground cube 119 through the screws 117 and into the aperture plate 119. As shown, this parallel heat path equates to less than 5% of the resistor heat load, but using fasteners that can be different in design and/or material than the steel countersunk screws can provide further heat transfer.

Figure 8B:
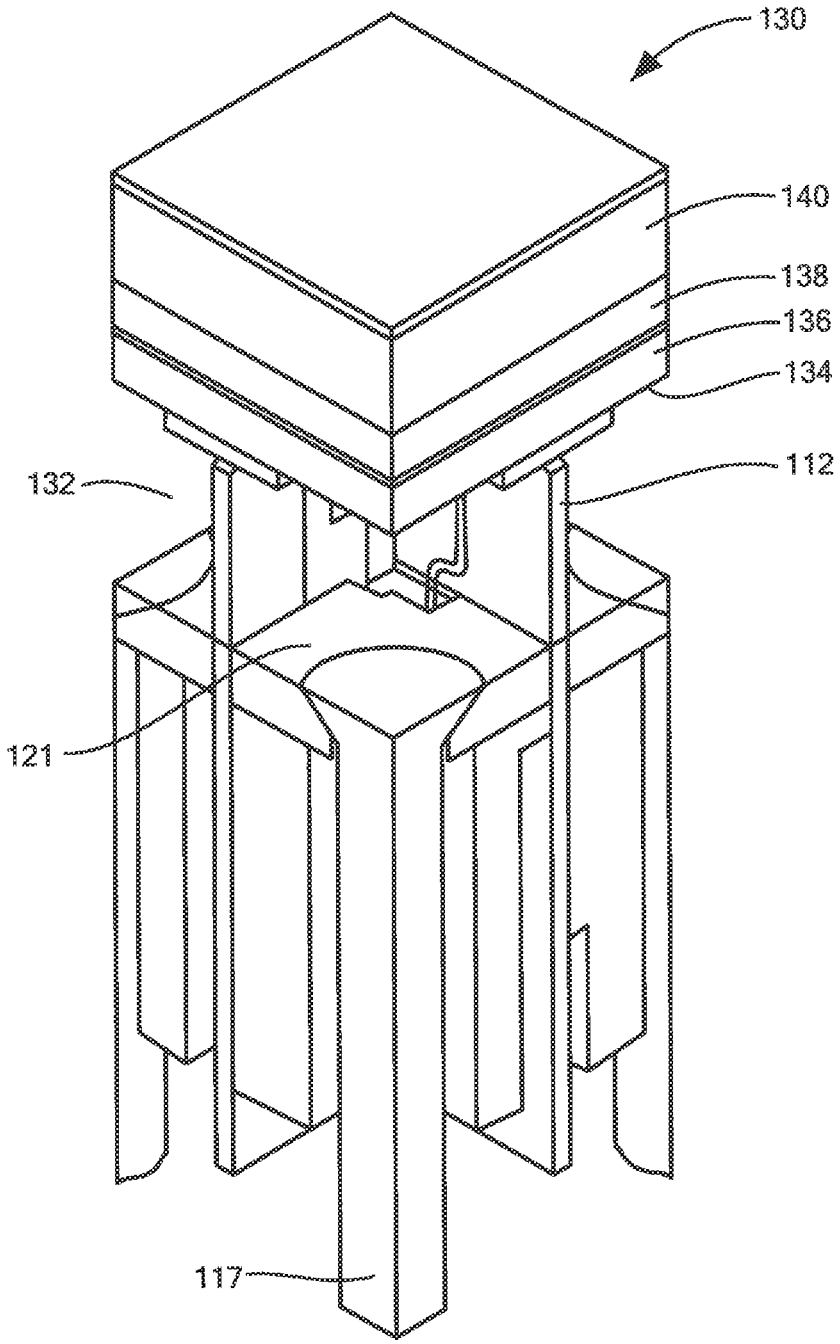
FIG. 8B is a schematic representation of a thumbtack radiator that can form a part of the array antenna of FIG. 8.

FIG. 8B is a sectional side view of a portion of an array antenna 130 showing a thumbtack radiator configuration in accordance with an embodiment. A screw 117 secures the eggcrate assembly panels 112 to the aperture plate 119 (FIG. 8A). As illustrated, the array antenna 130 may include an eggcrate structure 132 having a face sheet 134, a first antenna element layer 136 having a first array of parasitic tile elements, and a second antenna element layer 138 having a second array of parasitic tile elements that substantially align with the elements on the first layer 136. A wide angle impedance matching (WAIM) sheet 140 can optimize, for example, a particular angle or frequency of interest. An optional radome can cover the antenna 130 for protection from, for example, an exterior environment.

In the description above, various features, techniques, and concepts are described in the context of dual polarized, co-phase centered arrays. It should be appreciated, however, that these features are not limited to use within arrays with dual polarization or to arrays that have coincident phase centers. That is, most of the described features may be implemented in any type of array antennas.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. An array antenna, comprising:

a plurality of radiating elements on a first layer thereof, the plurality of radiating elements including elements that are driven in a balanced fashion;

an eggcrate structure below the first layer, the eggcrate structure comprising a plurality of first dielectric panels arranged in a first orientation and a plurality of second dielectric panels arranged in a second orientation and interconnected with the plurality of first panels;

at least one balun disposed on at least one of the dielectric panels of the egg create structure for use in feeding at least one of the radiating elements in the plurality of radiating elements;

an aperture plate from which the first and second dielectric panels extend, wherein the aperture plate provides a connection of the first and second dielectric panels to a ground plane for the antenna;

metal blocks secured onto ones of the first and second dielectric panels, wherein the metal blocks form a part of the ground plane of the antenna, a heatsink for the antenna, and a RF shield;

a power divider resistor for the at least one balun coupled directly to one of the metal blocks to form a thermal path to the aperture plate;

a plurality of spring probe interconnects disposed in the aperture plate to provide respective RF connections to respective ones of the first and second dielectric panels; and gaskets coupled onto the metal blocks, wherein compression of the gaskets provides thermal paths to the metal blocks and the aperture plate.

2. The antenna according to claim 1, wherein the antenna includes coincident phase center dual polarized radiators.

3. The antenna according to claim 1, wherein the gaskets comprise spring gaskets.

4. The antenna according to claim 1, further including an attachment mechanism to secure the eggcrate structure to the aperture plate.

5. The antenna according to claim 4, wherein the attachment mechanism comprises metal and forms part of the ground plane.

6. The antenna according to claim 1, wherein:

the at least one balun includes multiple baluns disposed on multiple dielectric panels of the egg create structure for use in feeding multiple radiating elements in the plurality of radiating elements.

7. The antenna according to claim 6, wherein:

some of the multiple baluns feed corresponding antenna elements in a first polarization direction and some of the multiple baluns feed corresponding antenna elements in a second polarization direction that is orthogonal to the first polarization direction.

8. The antenna according to claim 1, wherein:

the plurality of first dielectric panels and the plurality of second dielectric panels define a plurality of open regions within the eggcrate structure, wherein the metal blocks at least partially fill corresponding open regions in the eggcrate structure.

9. A method, comprising:

employing a plurality of radiating elements for an array antenna disposed on a first layer thereof, the plurality of radiating elements including elements that are driven in a balanced fashion;

employing an eggcrate structure below the first layer, the eggcrate structure comprising a plurality of first dielectric panels arranged in a first orientation and a plurality of second dielectric panels arranged in a second orientation and interconnected with the plurality of first panels;

employing at least one balun disposed on at least one of the dielectric panels of the egg create structure for use in feeding at least one of the radiating elements in the plurality of radiating elements;

employing an aperture plate from which the first and second dielectric panels extend, wherein the aperture plate provides a connection of the first and second dielectric panels to a ground plane for the antenna;

employing metal blocks secured onto ones of the first and second dielectric panels, wherein the metal blocks form a part of the ground plane of the antenna, a heatsink for the antenna, and a RF shield;

employing a power divider resistor for the at least one balun coupled directly to one of the metal blocks to form a thermal path to the aperture plate;

employing a plurality of spring probe interconnects disposed in the aperture plate to provide respective RF connections to respective ones of the first and second dielectric panels; and employing gaskets coupled onto the metal blocks, wherein compression of the gaskets provides thermal paths to the metal blocks and the aperture plate.

10. The method according to claim 9, wherein the antenna includes coincident phase center dual polarized radiators.

11. The method according to claim 9, wherein the gaskets comprise spring gaskets.

12. The method according to claim 9, further including employing an attachment mechanism to secure the eggcrate structure to the aperture plate.

13. The method according to claim 12, wherein the attachment mechanism comprises metal and forms part of the ground plane.

14. The method according to claim 9, wherein:

the at least one balun includes multiple baluns disposed on multiple dielectric panels of the egg create structure for use in feeding multiple radiating elements in the plurality of radiating elements.

15. The method according to claim 14, wherein:

some of the multiple baluns feed corresponding antenna elements in a first polarization direction and some of the multiple baluns feed corresponding antenna elements in a second polarization direction that is orthogonal to the first polarization direction.

16. The method according to claim 9, wherein:

the plurality of first dielectric panels and the plurality of second dielectric panels define a plurality of open regions within the eggcrate structure, wherein the metal blocks at least partially fill corresponding open regions in the eggcrate structure.

* * * * *